US008959975B2

(12) United States Patent
Welser et al.

(10) Patent No.: US 8,959,975 B2
(45) Date of Patent: Feb. 24, 2015

(54) METHOD FOR THE PRODUCTION OF A COLD-ROLLED PROFILE HAVING AT LEAST ONE THICKENED PROFILE EDGE

(75) Inventors: Thomas Welser, Ybbsitz (AT); Kurt Aigner, Ybbsitz (AT); Harald Schachinger, Waidhofen/Ybbs (AT)

(73) Assignee: Welser Profile Austria GmbH, Ybbsitz (AT)

( * ) Notice: Subject to any disclaimer, the term of this patent is extended or adjusted under 35 U.S.C. 154(b) by 499 days.

(21) Appl. No.: 13/055,588

(22) PCT Filed: Jul. 24, 2009

(86) PCT No.: PCT/EP2009/005403

§ 371 (c)(1),
(2), (4) Date: Mar. 2, 2011

(87) PCT Pub. No.: WO2010/009898

PCT Pub. Date: Jan. 28, 2010

(65) Prior Publication Data

US 2011/0197646 A1 Aug. 18, 2011

(30) Foreign Application Priority Data

Jul. 24, 2008 (DE) ..... 10 2008 034 488

(51) Int. Cl.

| | |
|---|---|
| ***B21D 31/00*** | (2006.01) |
| ***B21B 13/08*** | (2006.01) |
| ***B21B 31/08*** | (2006.01) |
| ***B21D 5/08*** | (2006.01) |

(52) U.S. Cl.

CPC ..... *B21D 5/08* (2013.01)
USPC ..... 72/377; 72/110; 72/225; 72/234; 72/238

(58) Field of Classification Search

USPC ..... 72/164, 177, 178, 181, 224, 225, 377, 72/107, 110, 234, 238; 29/893.32
See application file for complete search history.

(56) References Cited

U.S. PATENT DOCUMENTS

| | | | | | |
|---|---|---|---|---|---|
| 252,460 | A | * | 1/1882 | Harris | 72/225 |
| 4,433,565 | A | | 2/1984 | Preller | |
| 4,920,777 | A | * | 5/1990 | Kosak et al. | 72/225 |
| 5,191,780 | A | * | 3/1993 | Ohmori et al. | 72/224 |
| 5,774,986 | A | * | 7/1998 | Nishimura et al. | 29/893.32 |
| 6,016,602 | A | * | 1/2000 | Kanemitsu et al. | 29/893.32 |
| 6,112,409 | A | | 9/2000 | Jaekel | |

FOREIGN PATENT DOCUMENTS

| | | | |
|---|---|---|---|
| AT | 342950 | B | 4/1978 |
| DE | 2813636 | A1 | 10/1979 |
| DE | 19743093 | C1 | 12/1998 |
| JP | 55141330 | A | 11/1980 |
| RU | 2015774 | C1 | 7/1994 |
| WO | 86/00246 | A1 | 1/1986 |

* cited by examiner

*Primary Examiner* — Teresa M Ekiert
(74) *Attorney, Agent, or Firm* — Baker and Hostetler LLP

(57) ABSTRACT

A method for the production of a cold-rolled profile having at least one thickened profile edge made of a metal strip is provided. For this purpose the metal strip is guided through at least one clamping nip formed by at least one guide roll and at least one lateral edging roll, wherein the roll axis of the guide roll is disposed parallel to the web level of the metal strip, while the roll axis of the edging roll is disposed transverse to the roll axis of the guide roll, and is lined up at an angle to the strip level such that in addition to the upsetting force exerted by the edging roll onto the strip edge a clamping force is also applied that acts on the side of the metal strip facing away from the guide roll. The edging roll may be configured in steps, and surrounds the web edge at least on the side of the metal strip facing away from the guide roll.

11 Claims, 6 Drawing Sheets

METHOD FOR THE PRODUCTION OF A COLD-ROLLED PROFILE HAVING AT LEAST ONE THICKENED PROFILE EDGE

CROSS-REFERENCE TO RELATED APPLICATIONS

This application is a National Stage of International Patent Application No. PCT/EP2009/005403, filed on Jul. 24, 2009, which claims priority to foreign Patent Application No. DE 10 2008 034 488.5, filed on Jul. 24, 2008, the contents of which are incorporated herein by reference in their entirety.

FIELD OF INVENTION

The invention relates to a method for the production of a cold-rolled profile having at least one thickened profile edge made of a metal strip.

BACKGROUND OF THE INVENTION

Profiles made of rolling stock are known in many diverse embodiments and production processes. Corresponding profiles are made starting from an essentially rectangular, oblong, flat metal strip normally by bending or rolling the metal band or strip. Here, "bending or rolling" comprise all processing steps that can be used to form the metal strip blank to the desired shape, e.g. also by U-bending, edge bending, embossing, etc. The flat metal strip can here be reshaped essentially without changing the material thickness, or reshaping can comprise methods in which a profile is produced of a metal strip whose cross-sectional surface does not comprise a constant thickness but intentionally has regions of greater and smaller material thickness.

One possible profile which is given here by way of example is e.g. a C-shaped assembly rail, as well as an anchor rail which is usually produced by hot rolling or cold-profiling. Hot-rolled profiles are here rolled from a steel ingot, wherein the heated steel ingot passes ca. 8 different rolls which each have several so-called passes through which the ingots are passed a varying number of times. In hot rolling, it is easily possible to form the profile preshape together with a reduction in thickness, where rolling for thickness reduction leads to the displaced material flowing laterally. In material-intensive profiles, such as C-profiles, the proportion of material costs is more than 70%, so that material savings drastically cut total costs.

As opposed to this, cold-profiled rails of steel strip are produced on rolls in one single operation where no thickness reduction takes place, as due to the friction transverse to the roll and the stiffness of the flat rolling stock, thickness reduction is only converted into stretching in the longitudinal extension or the direction of rolling, respectively, and material solidification.

A method for changing the thickness of a metal strip is e.g. known from DE 197 43 093. Here, a metal strip with a thinner strip formed within the same is produced, where the strip is pulled through a drawing nip which is formed by the front side of a working roll lined up at an angle and a backup roll which can be configured as working roll. While the strip is pulled through this nip, the two rolls exert a rolling force on the strip and simultaneously a pulling force transverse to the pulling direction, such that the displaced material in the regions to be thinned quasi exclusively flows transverse to the pulling direction.

Another method for the production of a metal strip with various thicknesses and in particular with a thicker edge is known from JP 55141330. Here, a light-metal strip is first guided through a pair of rolls, one roll being provided with end sections projecting beyond the actual rolling skin, and the second roll having a smaller width than the first roll and being arranged between the end sections of the first roll. If the light metal is guided through the roll nip, the material is displaced or flows towards the end sections which are in this manner formed to be thicker.

SUMMARY OF THE INVENTION

It is the object of the present invention to provide a method for the production of a profile with various wall thicknesses which can be carried out particularly economically and where the correspondingly produced profile is characterized by particularly low material costs and production costs.

This object is achieved for a method for the production of a cold-rolled profile having at least one thickened profile edge made of a metal strip by the metal strip being guided through at least one clamping nip formed by a guide roll and at least one lateral edging roll, wherein the roll axis of the guide roll is disposed parallel to the strip level of the metal strip while the roll axis of the edging roll is disposed transverse to the roll axis of the guide roll and is lined up at an angle to the strip level such that in addition to the edging force or upsetting force exerted by the edging roll onto the strip edge, a clamping force is also applied that acts on the side of the metal strip facing away from the guide roll, the edging roll being configured in steps and surrounding the strip edge at least on the side of the metal strip facing away from the guide roll.

In contrast to the methods known up to now, the profile is consequently made of a metal strip which already has the desired thinnest thickness, and the material is only thickened by upsetting in the regions where thickening is required. In this manner, the profile can be produced more precisely by essentially less processing steps. As the total thickness of the metal strip is not changed during the process, the material costs can be kept at a minimum. According to the method according to the invention, essentially no undesired stresses are introduced into the material.

By the edging roll lined up at an angle, the method is controlled in an easy manner. The metal uniformly flows into the desired direction. Here, the edging roll retains one surface, i.e. the upper or the bottom side, of the metal strip, so that the metal strip is selectively deformed only in one direction while the other side remains in its original state. Equally, the step-by-step embodiment of the edging roll allows for a selective deformation of the metal strip which is firmly held by the edging roll.

According to a preferred embodiment, the angle between the roll axis of the guide roll and the roll axis of the edging roll can be between 92 to 100°. Corresponding angles have particularly proved their worth in practice and ensure sufficient upsetting and retention force of the edging roll.

Another preferred embodiment can provide for the stepped profile of the edging roll to be extended to a U-profile gripping around the strip edge on both sides, where the free U limb in abutment with the side facing away from the guide roll is configured to be essentially longer. This embodiment in particular prevents the formation of metal burs which otherwise often occur in upsetting processes between the individual rolls. By this, finishing of the metal strip can be reduced to a minimum and the total costs can be kept low.

According to a further preferred embodiment, at least one end section of the guide roll facing the edging roll can have a convex extension at a predetermined angle. The change of the shape of the guide roll here permits to also achieve, simultaneously with upsetting, a shaping of the thickened region corresponding to the convex end section of the guide roll.

According to still another preferred embodiment, upsetting can be performed in several steps, where at least the guide roll with a convex end region is after each upsetting step replaced by a guide roll whose at least one end region has a convex extension with a respectively larger angle than the previous one. As the change of the shape of the metal strip is performed in slow steps, the desired shape can be achieved particularly precisely without the material to be deformed being subjected to excessive stresses.

Advantageously, the angles of the at least one convex end region of the guide roll can change in steps of 1 to 10°, preferably 2 to 5°. These angles have proved to be particularly preferred in practice to perform a smooth change in shape.

According to a further preferred embodiment, a backup roll can be provided in addition which is disposed opposite to the guide roll, so that the metal strip is additionally clamped between the guide roll and the backup roll, where the backup roll has a narrower design than the guide roll and extends down to the edging roll at least at one side. In this manner, an improved guidance of the metal strip is achieved as a central region of the metal strip can be held between the guide roll and the backup roll. This also simplifies the design of the edging roll, as the step region or the free leg opposite to the guide roll does not have to have an excessively long configuration, e.g. approximately to the center of the metal strip, so that the edging roll can be employed more flexibly and are cheaper to manufacture.

According to another preferred embodiment, the last upsetting step can be followed by at least one deformation step for reshaping the thickened metal strip. By this, the formation of a desired profile can be carried out in one processing step with the thickening of certain regions of the metal strip.

Preferably, first the at least one thickened profile edge can be bent relative to the non-thickened region of the metal strip. Here, bending of the thickened profile edge can be carried out in steps until the outer surface opposite to the thickened surface is bent at an angle of ca. 90° to the non-thickened regions. As bending is not accomplished abruptly but slowly in several steps, a minimum amount of stress is exerted again onto the material.

Advantageously, the partially thickened metal strip can be reshaped to a C-shaped assembly rail. The method according to the invention proved to be particularly suited for a corresponding element.

BRIEF DESCRIPTION OF THE DRAWINGS

The invention will be illustrated more in detail below with reference to an embodiment. In the drawings.

DETAILED DESCRIPTION

Figure 1:
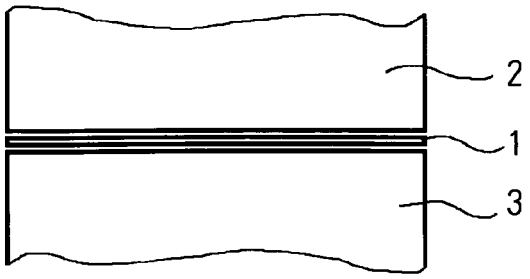
FIG. 1 shows a metal strip before upsetting according to the method according to the invention in a schematic representation.

Basically, the same parts are provided with the same reference numerals in the figures.

Figure 2A:
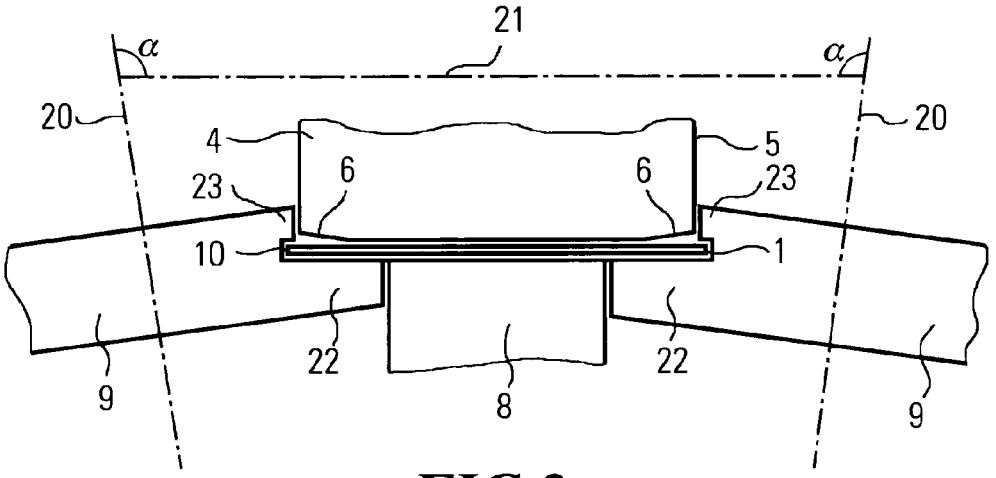
FIGS. 2 *a*)-*c*) show the metal strip represented in FIG. 1 in various stages of upsetting.
Figure 2B:
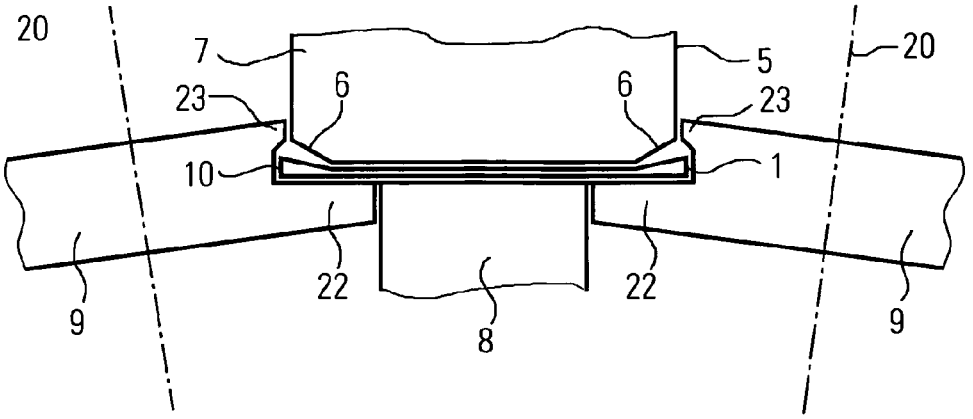

In FIGS. 1 and 2 *a*) to *c*), the method for obtaining a change in thickness at the strip edges of a metal strip is schematically shown.

Here, FIG. 1 shows a metal strip 1 introduced in a direction of rolling with a first roll 2 as well as a second roll 3 disposed oppositely, the metal strip 1 being held and guided between the two rolls. The metal strip 1 here has a predetermined thickness in accordance with the desired final thickness of the essential regions of the metal strip 1.

In FIG. 2, various steps of upsetting the strip edges of the metal strip 1 are represented more in detail, where three individual procedure steps are shown, the actual method, however, can comprise a plurality of further steps to here obtain a gradual change of the thickness of the strip edges and the shaping of a profile.

The roll device represented in FIG. 2 *a*) differs from the roll device represented in FIG. 1 in that the roll 2 was replaced by a guide roll 4 and the roll 3 was replaced by a backup roll 8 which has a clearly narrower configuration than the guide roll 3. The width of the roll 8 is here selected such that the metal strip 1 extends on both sides beyond the front faces of the backup roll 8. The clamping nip formed between the guide roll 4 and the backup roll 8 in which the metal strip 1 is guided here has the same height as in FIG. 1, so that the thickness of the metal strip in the region of the surfaces of the rolls disposed parallel to each other is not changed; the function of the two rolls rather is to hold and guide the metal strip during upsetting which is performed laterally. The roll axes of both rolls 4 and 8 are disposed parallel to the strip level.

As is represented in FIG. 2, the guide roll 4 extends beyond the backup roll 8 on both sides and is beveled in the region of the end sections 6 of the roll surface adjacent to the front faces 5, so that the roll surface has a convex extension. The metal strip 1 also extends beyond the front faces 6 of the roll 4 on both sides in the region of the guide roll 4.

The actual upsetting operation is performed by the edging rolls 9 which are disposed on both sides at the front faces or the strip edge 10 of the metal strip 1. In contrast to the guide or backup roll, the roll axis of the edging roll 9 is disposed essentially transverse to the roll axis of the guide roll and lined up at an angle to the strip level. This results in an angle $\alpha$ of more than 90°, preferably between 92° and 100° between the roll axis 20 of the edging roll 9 and the roll axis 21 of the guide roll 4.

The edging rolls have a profiled design in the region adjacent to the metal strip 1 to grip around the strip edge and at least one adjacent end section of the metal strip surface, i.e. the metal strip surface facing away from the guide roll 4. The edging roll 9 represented in FIG. 2 is configured with a U-shaped profile, one free U limb each additionally gripping around the strip edge at both metal strip surfaces. Here, however, the U limbs have different lengths, the free U limb 22 at the bottom side of the metal strip, i.e. at the side facing away from the guide roll 4, is configured to be much longer than the opposite U limb 23 and essentially extends to the front faces of the backup roll 8. The free U limb 22 furthermore comprises dimensions such that it extends beyond the convexly embodied end sections 6 of the guide roll 4. By this, the stresses arising in this region are better distributed to the complete material. Simultaneously, the formation of burs is eliminated.

The region of the metal strip 1 to be deformed is consequently held between the guide roll 4 and the edging roll 9 during the upsetting operation, and the strip edges 10 of the metal strip are upset by the edging rolls 9 exerting a force in the direction of the clamping nip, wherein the material is deformed by this upsetting operation and penetrates into the clamping nip formed between the convex end sections 6 of the guide rolls 4 and the free U limbs 22 of the edging rolls 9. Here, the clamping nip formed between the guide roll 4 and the edging roll 9 is configured to be broader at least in the region of the convex end sections 6 than the clamping nip formed between the guide roll 4 and the backup roll 8.

The first upsetting step is completed when the clamping nip present in the region of the convex end sections 6 of the guide roll 4 and the edging roll 9 is completely filled with the material of the metal strip 1, i.e. the strip edge has been deformed by upsetting.

Subsequently, the guide roll 4 is replaced by a new guide roll 7 which in turn has a smaller width than the now partially thickened metal strip, so that the partially thickened metal strip extends at the two strip edges beyond the front faces 5 of the guide roll 7. In contrast to the first guide roll 4, in the new guide roll 7, the convex end sections 6 are also more bent, so that despite the partially thickened end region of the metal strip 1, a nip still exists which is formed between the surface of the metal strip 1 and the convex end sections 6 of the guide roll 7. There are no changes of the metal strip at the opposite surface, but it still extends parallel to the roll surface of the backup roll 8 or parallel to the free U limb 22 of the edging roll 9 forming one level with the roll surface of the backup roll 8.

The edging roll 9 can also be replaced by a new one after each upsetting step to take the increasing deformation of the strip into consideration, e.g. to adjust the profiling of the edging roll to the respective new deformation.

By exerting again pressure onto the strip edges by the edging rolls 9, the material of the metal strip 1 is upset again, and the newly formed nip is thus filled with the material deforming in this manner.

These individual upsetting steps can be carried out successively each with a new guide roll and a new edging roll, while the backup roll 8 is maintained unchanged, until desired thickening is achieved. If the metal strip is continuously pushed or pulled through successive rolls in a rolling mill, of course, a new backup roll 8 is also employed in each step, which, however, can correspond to the previous one. If the edging roll is to be maintained unchanged during the individual steps, however, it would be necessary to change the width of the backup roll step by step to take the upsetting into consideration.

Preferably, deformation of the metal strip 1 is performed in slow steps, wherein the convex end sections 6 each extend at a greater angle, preferably in steps of three degrees each, until a desired final bevel is achieved, as is shown e.g. in FIG. 2 *c*).

As the strip edge is upset in each case between the convex end regions, simultaneously with thickening, a selective deformation of the metal strip, and thus the formation of a profile, are accomplished.

Figure 2C:
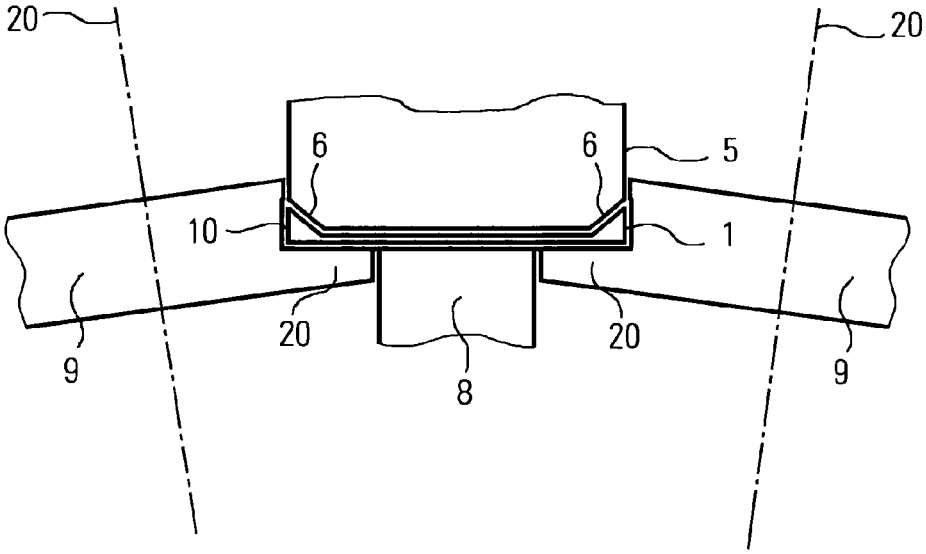

In the last upsetting step, the edging roll 9 can be embodied with a stepped profile, as represented in FIG. 2*c*, where only one free limb 25 is in abutment with the bottom side of the metal strip and the rest of the profile is disposed parallel to the front face 5 of the guide roll. This determines the final shape of the thickened region.

Figure 3:
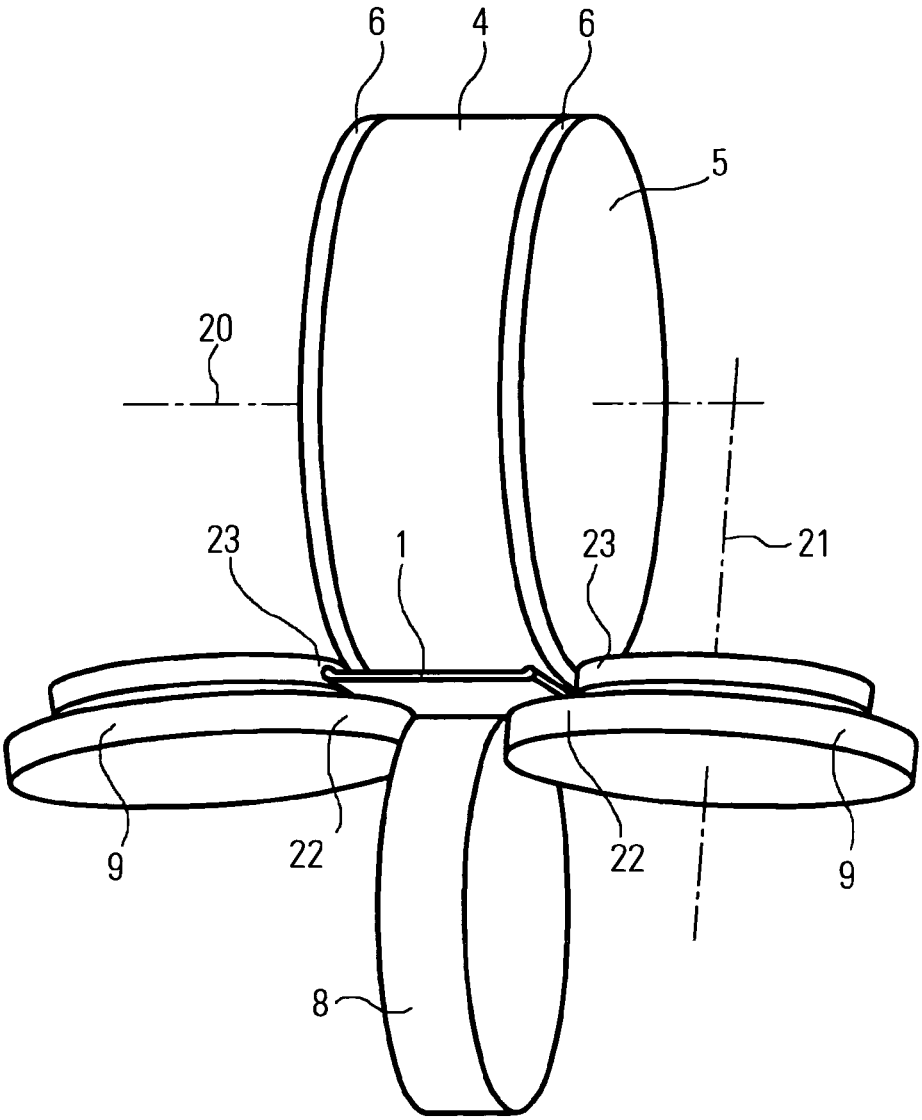
FIG. 3) shows an upsetting step represented in FIG. 2 in a three-dimensional representation.
Figure 4:
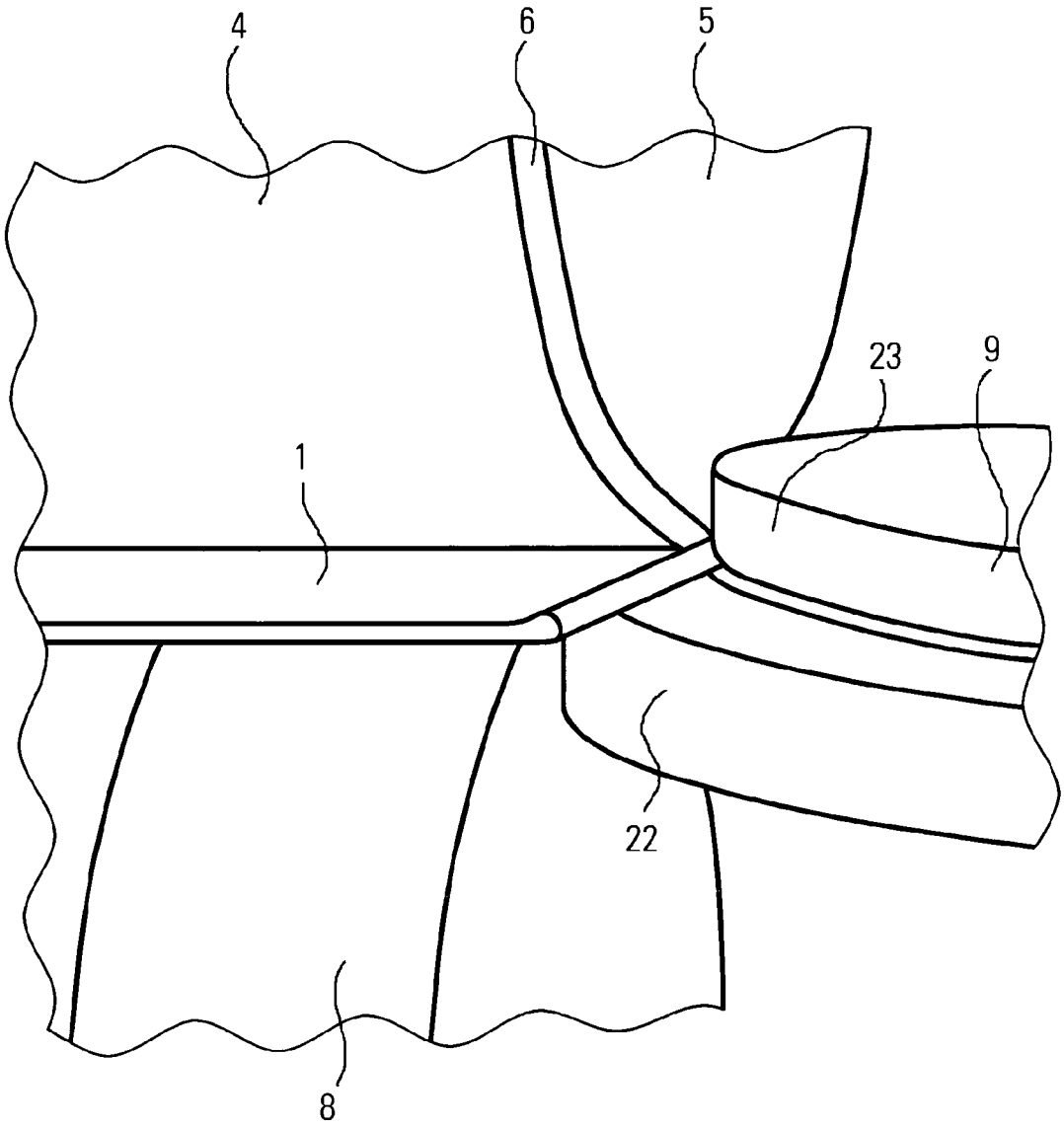
FIG. 4) shows an enlarged detail of FIG. 3.

In FIGS. 3 and 4, the upsetting operation is again illustrated with reference to a three-dimensional representation, where FIG. 4 shows an enlarged detail of FIG. 3. Both Figures show how a central region of the metal strip 1 is held between the guide roll 4 and the backup roll 8. Both rolls are disposed parallel to each other, and the roll axes extend parallel to each other and parallel to the strip level. The end sections of the guide roll extend concavely, i.e. they are provided with a chamfer. This region serves the deformation of the metal strip in the subsequent upsetting.

The end sections of the metal strip 1, i.e. the regions of the metal strip 1 extending beyond the backup rolls 8, are held at the upper side of the metal strip by the guide roll and at the bottom side of the metal strip by laterally arranged backup rolls 9. The backup rolls are tilted relative to the strip level, i.e. they are slightly inclined downwards away from the guide rolls. By this inclination of the backup rolls 9, sufficient force can also be transmitted from the backup rolls 9 to the bottom side of the metal strip to prevent deformation here.

The backup roll has a profiled design, so that the backup roll surrounds not only a region of the bottom side of the metal strip, but also the strip edge and a region of the upper side of the metal strip. In contrast to the limb 22 of the backup roll in abutment with the bottom side of the metal strip, which clearly extends beyond the region to be thickened, the upper side of the metal strip is only guided over a portion of the thickened region. As represented in the present example, the region between the two U limbs can have a rounded design to deform the metal strip 1 corresponding to the rounding.

After the metal strip 1 has been embodied with a thickened strip edge by the desired number of upsetting steps, wherein the thickened region is only embodied as end sections uniformly extending to the outside at a predetermined angle in the region of one surface of the metal strip 1, the metal strip obtained in this way is deformed to the desired end profile in a deformation process directly following upsetting.

Figure 5A:
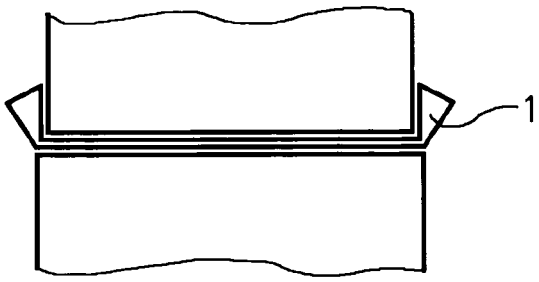
FIGS. 5 *a*)-*b*) show two different deformation steps of the partially thickened metal strip obtained after upsetting.
Figure 5B:
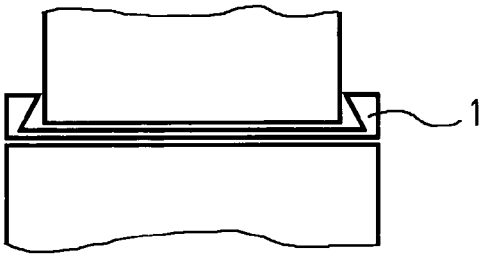

Here, the thickened end sections of the metal strip 1 are first bent, this bending neither being performed abruptly but slowly in a plurality of individual deformation steps. In FIGS. 5 *a*) and 5 *b*), different steps are represented during deformation, first, as represented in FIG. 5, after the thickened surface has been bent at an angle of 90° to the unchanged surface of the metal strip 1, and then in FIG. 5 *b*), the completed bent profile, where the two thickened end sections extend towards each other, and the unchanged surface of the metal strip 1 is bent at an angle of 90°.

Figure 6A:
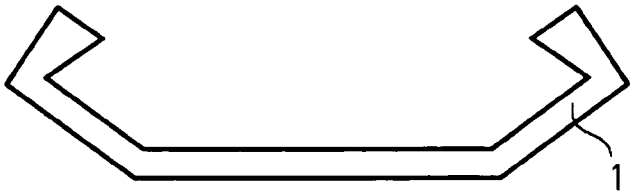
FIGS. 6 *a*)-*c*) show various stages in the reshaping of the metal strip according to the above figures for the production of a C-shaped anchor rail in a schematic representation.
Figure 6B:
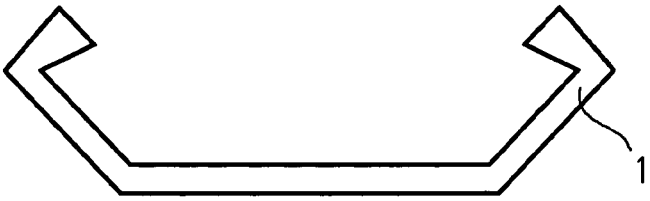
Figure 6C:
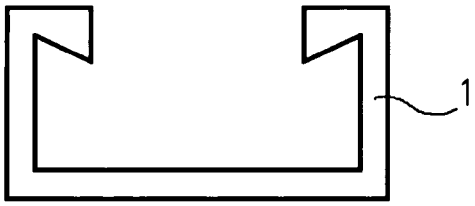

To deform the correspondingly obtained profile in FIG. 5 e.g. to a C-shaped assembly rail, a plurality of further deformation processes can be employed, where deformation is performed here, too, in steps. FIGS. 6 *a*) and 6 *b*) show two partially deformed profiles during the deformation process.

The completed deformed profile in the form of a C rail is finally shown in FIG. 6 *c*). Here, the completed deformed profile comprises a base region 10 as well as two limbs 11 and 12 extending perpendicularly thereto and finally followed by the bent thickened region. The bent thickened regions here extend towards each other, a gap being formed between the two regions.

What is claimed is:

1. Method for the production of a cold-rolled profile made of a metal strip, the method comprising:

cold-rolling the metal strip through at least one clamping nip formed by a guide roll and at least one lateral edging roll, disposing a roll axis of the guide roll parallel to a strip level of the metal strip, applying a clamping force on a side of the metal strip facing away from the guide roll in addition to exerting an upsetting force by the edging roll onto a strip edge while a roll axis of the edging roll is disposed transverse to the roll axis of the guide roll and is lined up at an angle to the strip level, and surrounding the strip edge at least on the side of the metal strip facing away from the guide roll with a stepped profile of the edging roll to produce at least one thickened profile edge, wherein at least one end section of the guide roll facing the edging roll extends convexly at a predetermined angle, and wherein the upsetting force is applied in several upsetting steps, each upsetting step comprising replacing at least the guide roll after each previous upsetting step by a successive guide roll having at least one end region extending convexly at a larger angle than the angle of the previous guide roll.

2. Method according to claim 1, wherein an angle between the roll axis of the guide roll and the roll axis of the edging roll is between 92° to 100°.

3. Method according to claim 1, further comprising:

extending the stepped profile of the edging roll to be a U-profile that grips around the strip edge on both sides, wherein a longer free limb of the U-profile abuts the side facing away from the guide roll.

4. Method according to claim 1, wherein each larger angle of the end region of each successive guide roll changes in steps of 1° to 10°.

5. Method according to claim 4, wherein each larger angle of the end region of each successive guide roll changes in steps of 2° to 5°.

6. Method according to claim 1, further comprising disposing a backup roll opposite to the guide roll so that the metal strip is additionally clamped between the guide roll and the backup roll, the backup roll being configured to be narrower than the guide roll and extending to a buckling roll on at least at one side.

7. Method at least according to claim 1, wherein after the last upsetting step, performing at least one deformation step for reshaping the thickened profile edge of the metal strip.

8. Method according to claim 7, further comprising:

bending the at least one thickened profile edge relative to a non-thickened region of the metal strip.

9. Method according to claim 8, wherein the bending of the thickened profile edge is carried out step by step until end sections of an opposite outer surface of the metal strip corresponding to the thickened profile edge is bent at an angle of about 90°.

10. Method according to claim 1, further comprising shaping the metal strip to a desired profile shape in a non-thickened region by at least one bending method.

11. Method according to claim 10, further comprising reshaping the metal strip to a C-shaped assembly rail, wherein the thickened edge profile is disposed extending towards a second thickened edge profile.

* * * * *